US011172770B2

(12) United States Patent
Nguyen

(10) Patent No.: US 11,172,770 B2
(45) Date of Patent: Nov. 16, 2021

(54) HIGH EFFICIENT NIGHT COVER

(71) Applicant: Hussmann Corporation, Bridgeton, MO (US)

(72) Inventor: Ken Nguyen, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 1322 days.

(21) Appl. No.: 14/032,402

(22) Filed: Sep. 20, 2013

(65) Prior Publication Data

US 2015/0087221 A1 Mar. 26, 2015

(51) Int. Cl.
*A47F 3/04* (2006.01)

(52) U.S. Cl.
CPC ..... *A47F 3/0469* (2013.01)

(58) Field of Classification Search
CPC .... A47F 3/0469; E06B 3/80; F24F 2009/005; F24F 2011/0087; F24F 9/00; F25D 23/02; F25D 2500/02
USPC ..... 312/116, 115, 138.1, 236, 297; 160/332, 160/241, 327, 328, 354, 23.1, 265, 330, 160/349.1; 62/256, 249, 265, 255, 64
See application file for complete search history.

(56) References Cited

U.S. PATENT DOCUMENTS 2,757,628 A 8/1956 Johnston
3,186,185 A * 6/1965 Bently ..... A47F 3/0447 312/297
3,306,353 A 2/1967 Bume
3,415,316 A 12/1968 Bume et al.
3,439,739 A 4/1969 Jaeger
3,508,606 A 4/1970 Blanchard et al.
4,288,992 A * 9/1981 Eliason ..... E06B 3/80 160/332
4,313,485 A 2/1982 Gidge et al.
4,392,360 A 7/1983 Gidge et al.
4,400,046 A 8/1983 Karashima
4,424,685 A 1/1984 Ibrahim
4,429,548 A 2/1984 Layne
4,550,760 A 11/1985 Gidge et al.
(Continued)

FOREIGN PATENT DOCUMENTS

DE 29804329 5/1998
DE 20316553 U1 * 3/2004 ..... A47F 3/0469
(Continued)

OTHER PUBLICATIONS

WO2005074757MT, machine translation of WO2005/074757A1.*
(Continued)

*Primary Examiner* — Steven B McAllister
*Assistant Examiner* — Elizabeth M. May
(74) *Attorney, Agent, or Firm* — Michael Best & Friedrich LLP

(57) ABSTRACT

A night cover for a refrigerated merchandiser that is positionable to substantially enclose a product display area of the merchandiser. The night cover includes a first portion and a second portion that is disposed above the first portion. The second portion cooperates with the first portion to define a first surface area, and the second portion defines a second surface area and has an open section configured to permit ambient airflow through the night cover. A ratio of the first surface area to the second surface area is between approximately 7:1 and 18:1.

9 Claims, 7 Drawing Sheets

(56) References Cited

U.S. PATENT DOCUMENTS

| | | | | |
|---|---|---|---|---|
| 4,801,180 | A | 1/1989 | Styles | |
| 4,923,258 | A * | 5/1990 | Styles | A47F 3/0469 160/241 |
| 6,279,335 | B1 | 8/2001 | Jacobs | |
| 6,474,983 | B1 | 11/2002 | Robbins | |
| 7,508,663 | B2 * | 3/2009 | Coglitore | H05K 7/20736 165/122 |
| 2006/0266483 | A1 * | 11/2006 | Roberts | A47H 23/08 160/179 |
| 2008/0087389 | A1 * | 4/2008 | Govan | A47H 23/10 160/330 |
| 2012/0018106 | A1 * | 1/2012 | Robledo | A47H 1/04 160/330 |
| 2012/0090794 | A1 * | 4/2012 | Serio | A47H 1/04 160/237 |
| 2013/0075056 | A1 * | 3/2013 | Fernandez | H05K 7/186 165/45 |
| 2013/0174991 | A1 * | 7/2013 | Glikman | A47H 1/14 160/330 |

FOREIGN PATENT DOCUMENTS

| | | |
|---|---|---|
| EP | 0630601 | 12/1994 |
| EP | 2218360 | 8/2010 |
| NZ | 573463 | 5/2001 |
| WO | 2005074757 | 8/2005 |
| WO | 2006074353 | 7/2006 |
| WO | 2009017832 | 2/2009 |

OTHER PUBLICATIONS

Translation_DE20316553U1, partial machine translation of DE 20316553 U1.*

First Examination Report from the New Zealand Intellectual Property Office for Application No. 702403 dated Dec. 4, 2014 (2 pages).

First Examination Report from the New Zealand Intellectual Property Office for Application No. 702404 dated Dec. 4, 2014 (2 pages).

Future Examination Report from the New Zealand Intellectual Property Office for Application No. 625802 dated Dec. 4, 2014 (2 pages).

First Examination Report from the New Zealand Intellectual Property Office for Application No. 625802 dated Jun. 23, 2014 (3 pages).

Extended European Search Report for Application No. 14170542.6 dated Jan. 22, 2015 (7 pages).

* cited by examiner

HIGH EFFICIENT NIGHT COVER

BACKGROUND

The present invention relates to a night cover for a refrigerated merchandiser, and more specifically to a night cover that permits ambient airflow into the merchandiser.

Refrigerated merchandisers generally include a case defining a product display area for supporting and displaying food products to be visible and accessible through an access opening in the front of the case. Refrigerated merchandisers are generally used in retail food store applications such as grocery or convenient stores or other locations where food product is displayed in a refrigerated condition. Some refrigerated merchandisers include doors to enclose the product display area of the case and reduce the amount of cold air released into the surrounding environment. Other existing merchandisers are open to the ambient environment and utilize one or more air curtains that flow across the access opening to provide a barrier between the product display area inside the merchandiser and the ambient air outside of the merchandiser.

Some open-front merchandisers use curtains covers to enclose the product display area during non-peak hours of operation. In upright merchandisers, the night cover extends between the canopy of the merchandiser and the base of the merchandiser, and acts as a barrier that protects the cold air curtain from infiltration of warm ambient air. Existing night covers typically do not seal the product display area. Instead these night covers have small gaps through which warm, ambient air rushes into the product display area to replace cold air escaping the merchandiser. The rush of warm, ambient air into the product display area penetrates the cold air curtain in the merchandiser and increases product temperatures in the merchandiser.

SUMMARY

In one construction, the invention provides a night cover for a refrigerated merchandiser that is positionable to substantially enclose a product display area of the merchandiser. The night cover includes a first portion and a second portion that is disposed above the first portion. The second portion cooperates with the first portion to define a first surface area, and the second portion defines a second surface area and has an open section configured to permit ambient airflow through the night cover. A ratio of the first surface area to the second surface area is between approximately 7:1 and 18:1.

In another construction, the invention provides a refrigerated merchandiser including a case that defines a product display area and that includes an access opening adjacent the product display area. The merchandiser also includes an air curtain that is directed across the access opening to condition the product display area, and a night cover that is coupled to the case and movable on the case from a stowed position to a deployed position extending across the access opening to substantially enclose the product display area. The night cover includes an open section that is configured to permit ambient airflow through the night cover.

In another construction, the invention provides a night cover assembly for a refrigerated merchandiser. The merchandiser defines a product display area and has an access opening adjacent the product display area. The night cover assembly includes a housing that is attachable to the merchandiser, and a night cover that is coupled to the housing. The night cover has a stowed position in the housing and is movable relative to the housing to a deployed position to extend across the access opening. The night cover includes an open section configured to permit ambient airflow through the night cover.

Other aspects of the invention will become apparent by consideration of the detailed description and accompanying drawings.

Before any constructions of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
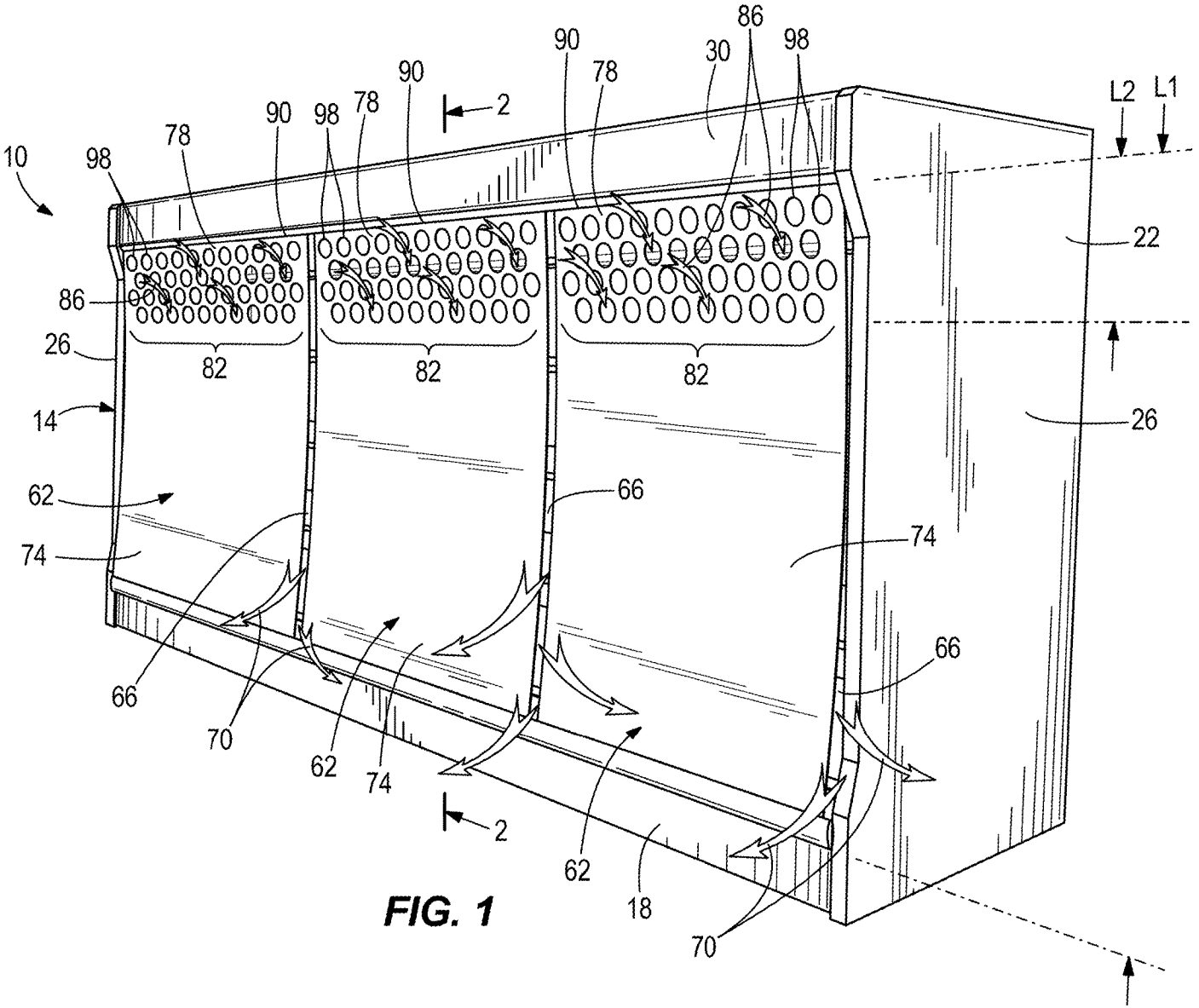
FIG. 1 is a perspective view of a refrigerated merchandiser including night covers embodying the present invention, with each night cover having an open section located adjacent a canopy of the merchandiser.
Figure 2:
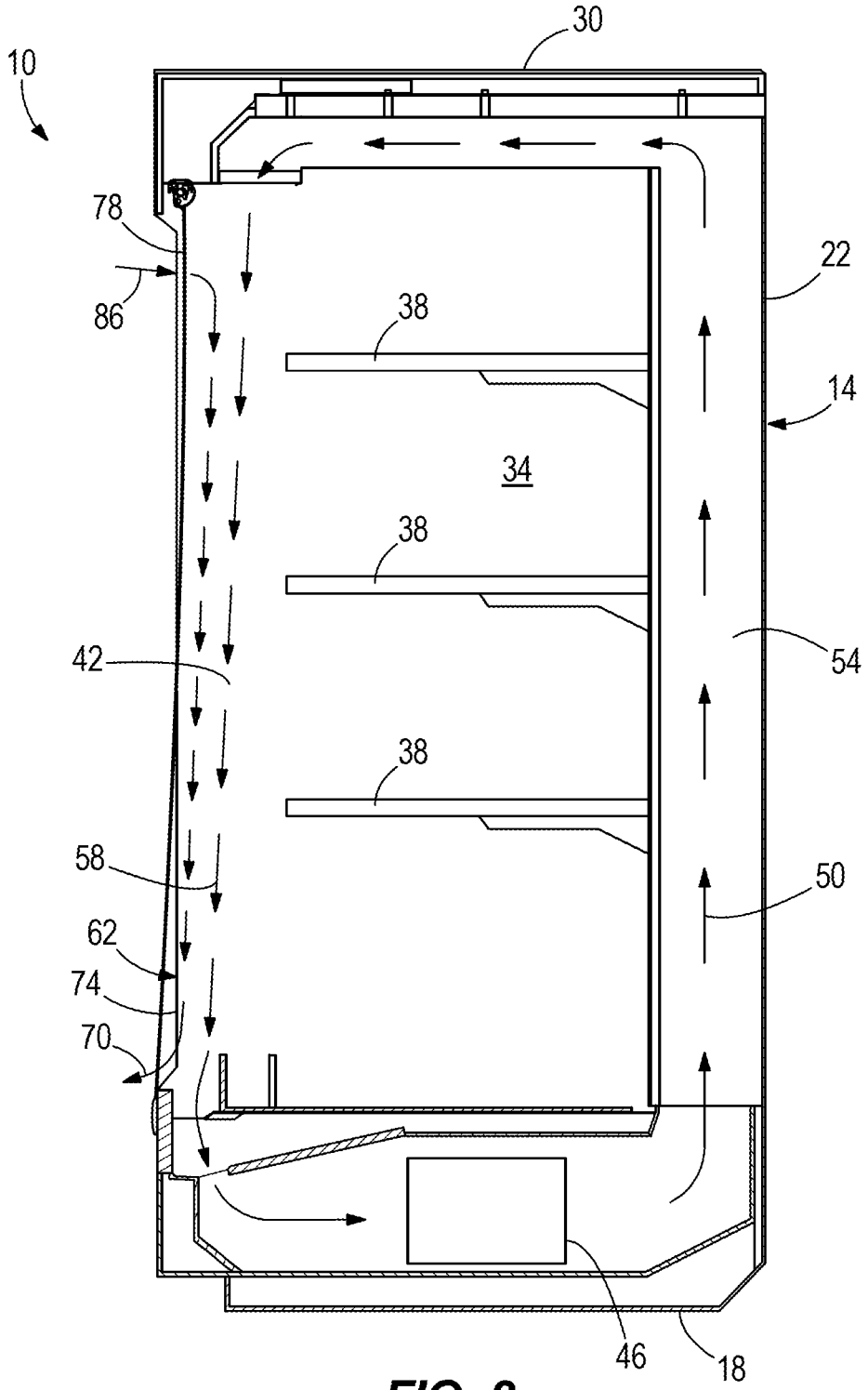
FIG. 2 is a section view of the refrigerated merchandiser and one night cover of FIG. 1 taken along line 2-2.

FIGS. 1 and 2 show a refrigerated merchandiser 10 that may be located in a supermarket or a convenience store (not shown) for presenting fresh food, beverages, and other food product to consumers. Although the merchandiser 10 is illustrated as an upright merchandiser, the merchandiser 10 can take other forms (e.g., horizontal merchandiser, etc.). The merchandiser 10 includes a case 14 that has a base 18, a rear wall 22, side walls 26, and a canopy 30. The area partially enclosed by the base 18, rear wall 22, side walls 26, and the canopy 30 defines a product display area 34 that supports the food product in the case 14. The food product is displayed on racks or shelves 38 extending forwardly from the rear wall 22, and is accessible by consumers through an access opening 42 adjacent the front of the case 14.

Referring to FIG. 2, at least a portion of a refrigeration system 46 (illustrated schematically) is in communication with case 14 to provide a refrigerated airflow (denoted by arrows 50) to the product display area 34. The refrigeration system 46 includes an evaporator (not shown), a compressor (not shown), and a condenser (not shown) connected in series with each other. As is known in the art, the evaporator receives a saturated refrigerant that has passed through an expansion valve from the condenser. The saturated refrigerant is evaporated as it passes through the evaporator as a result of absorbing heat from air passing over the evaporator. The absorption of heat by the refrigerant allows the temperature of the air to decrease as it passes over the evaporator. The heated or gaseous refrigerant then exits the evaporator and is pumped back to the compressor for re-processing into the refrigeration system 46. The cooled airflow 50 exiting the evaporator via heat exchange with the liquid refrigerant is directed through an air passageway 54 along the rear wall 22 and canopy 30 and is introduced into the product display area 34 as an air curtain 58 that maintains the food product at desired conditions.

Figure 3:
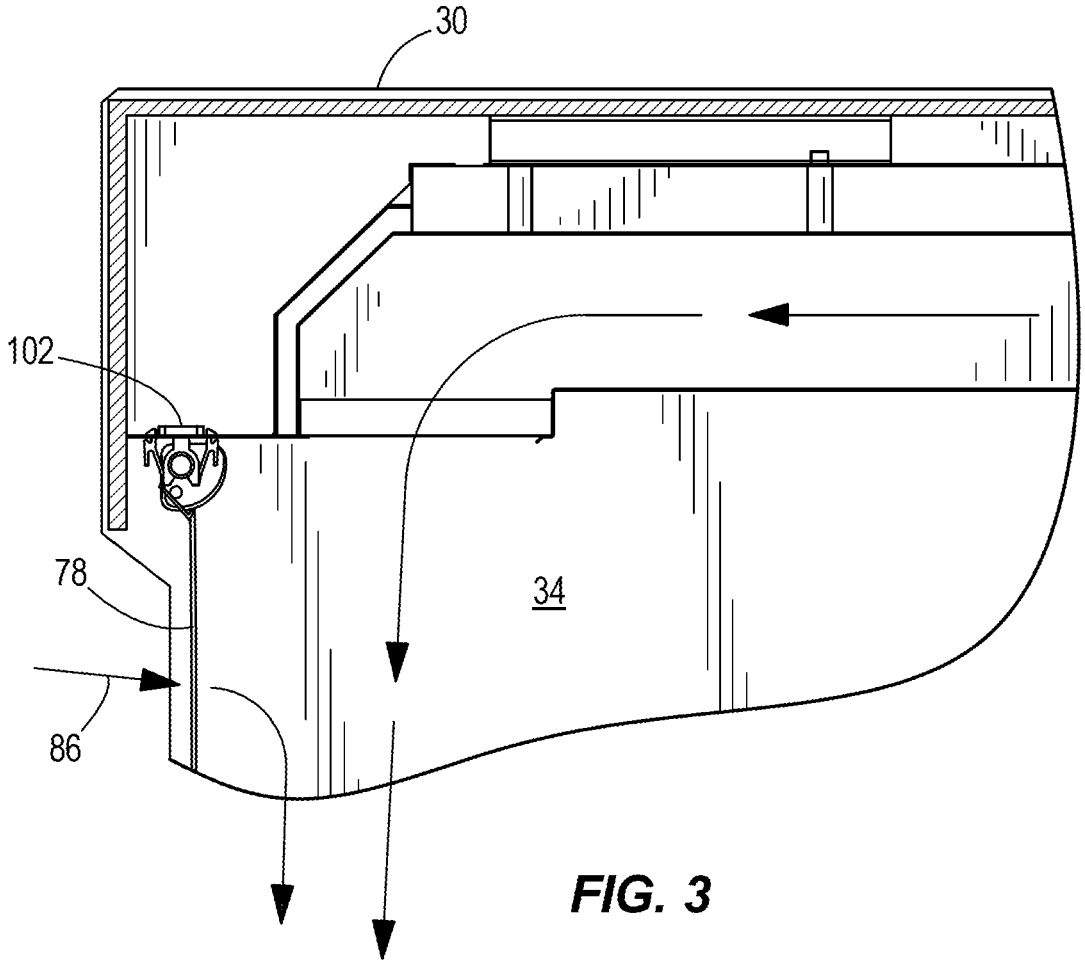
FIG. 3 is an enlarged view of an upper portion of the refrigerated merchandiser and the night cover of FIG. 2.

Referring to FIGS. 1-3, the refrigerated merchandiser 10 includes night covers 62 that substantially cover the access opening 42 and enclose the product display area 34 during periods of non-use of the merchandiser 10 (e.g., during overnight hours). Generally, the night covers 62 reduce energy consumption by separating ambient air in the environment surrounding the merchandiser 10 from the product display area 34 and the air curtain 58. Although the illustrated merchandiser 10 includes three night covers 62 each enclosing one section of the merchandiser 10, the merchandiser 10 can include fewer or more than three night covers 62.

As illustrated, each night cover 62 is coupled to the case 14 adjacent the canopy 30 and extends from the canopy 30 toward the base 18, although the night covers 62 can extend across the access opening 42 from the side walls 26 or upward from the base 18. Each illustrated night cover 62 has an overall exposed height or length (denoted by L1 in FIG. 1) along the front of the merchandiser 10 as measured in a vertical direction between the canopy 30 and the base 18. The night cover also has a width extending in the direction between the side walls 26. Due to the arrangement of the night covers 62 on the merchandiser 10, small gaps 66 exist between and around the night covers 62 such that cold air (denoted by arrows 70) from the product display area 34 spills out of the merchandiser 10.

Each night cover 62 includes a lower portion 74 and an upper portion 78 disposed above the lower portion 74. The terms "lower" and "upper" as used herein are in reference to viewing the merchandiser 10 from in front of the merchandiser 10 or from above the merchandiser 10. The lower portion 74 is defined by a solid section of material and substantially encloses the lower portion of the access opening 42. In some constructions, the lower portion 74 and the upper portion 78 can be separate pieces that are fixed or releasably attached to each other.

The upper portion 78 is defined by an open section 82 that permits entry of warm, ambient air (denoted by arrows 86) into the merchandiser 10 to make up for the spillage of cold air through the gaps 66 between and around the night covers 62. As illustrated, the open section 82 is disposed adjacent a top edge 90 of the night cover 62 and extends across the entire width of the night cover 62. In some constructions, the open section 82 can be spaced from the top edge 90. Also, the open section can extend across a partial width of the night cover 62. The open section 82 has an exposed height or length (denoted by L2 in FIG. 1) along the front of the merchandiser 10 as measured in the vertical direction.

The length L2 of the open section 82 is sized to permit some ambient airflow through the night cover 62 without substantially impacting the temperature of product supported in the product display area 34. As illustrated, the open section 82 has a length L2 that is between approximately 5%-15% of the overall length L1 of the night cover 62. In some constructions, the exposed length L2 can be between approximately 8%-12% of the overall exposed length L1 (e.g., approximately 10%). Stated another way, the night cover 62 (i.e. the lower portion 74 and the upper portion 78) defines a first surface area and the upper portion 78 defines a second surface area, and the ratio of the first surface area to the second surface area is between approximately 7:1 and 18:1. In some constructions, the ratio can be between approximately 9:1 and 14:1. For example, for a night cover 62 with an overall length L1 of 55 inches, the length L2 of the open section 82 can be between approximately 4 inches and 6 inches.

As shown in FIGS. 1-3, the night cover 62 is disposed in a housing 94 that is attached to the case 14. The night cover 62 is movable (e.g., manually or via electronic control based on sensed movement, a timing program, etc.) from a stored or stowed position across the access opening 42 to a fully extended or deployed position to maintain a desired temperature range within the product display area 34. In the stowed position, the night cover 62 is wrapped about itself within the housing 94. The illustrated night cover 62 is a pull-down night cover that is positioned in and coupled to the canopy 30, and that can be pulled down to substantially enclose the access opening 42. The open section 82 is disposed adjacent the canopy 30 in the deployed position. In other forms of the night cover 62, the night cover 62 can be pulled across or upward over the access opening 42. The night cover 62 can be biased to the stowed position by a biasing element (not shown) that is coupled to the housing and the night cover 62. An attachment element (e.g., hook and loop fasteners, hooks, etc. can be used to secure the free end of the night cover 62 (i.e. the end opposite the housing 94) to the case 14.

In some constructions, the night cover 62 may be fully exposed or only partially exposed along the front of the merchandiser 10 when the night cover 62 is extended across the access opening 42. For example, in a merchandiser 10 with a small access opening 42, only a portion of the night cover 62 may extend across the access opening 42. The remaining portion of the night cover 62 would remain wrapped up in the housing 102. In a merchandiser 10 with a relatively large access opening 42, the entire night cover 62 may be fully unwrapped to extend across the access opening 42. By placing the open section 82 along the top edge 90 of the night cover 62 (i.e., in the area of the night cover 62 that is closest and attached to the housing 94), the open section 82 is exposed only as much as necessary, based on the size of the access opening 42, to accommodate ambient airflow through the night cover 62 to make up for the spilled cold air leaving the merchandiser 10 without having the ambient airflow penetrate the air curtain 58.

The open section 82 can be defined by one or more openings 98 in the night cover 62. With reference to FIG. 1-3, the open section 82 has a plurality of substantially uniform circular openings 98 that permit passage of warm ambient air through the night cover 62. In other constructions, the openings 98 can have an ovular or other polygonal shape.

Figure 4:
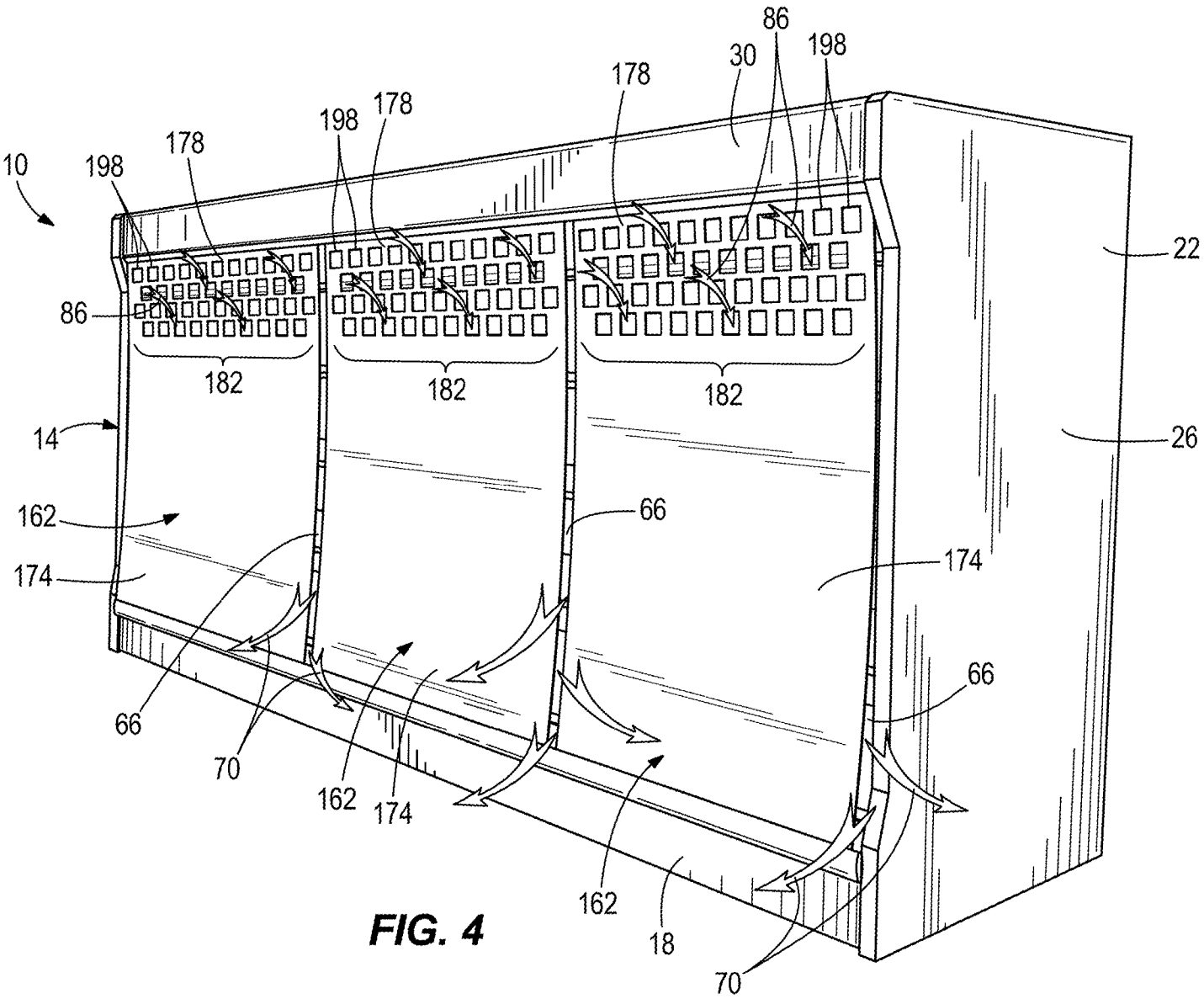
FIG. 4 is a perspective view of the merchandiser including night covers with open sections defined by a plurality of rectangular openings.

For example, FIG. 4 illustrates another night cover 162 that can be used with the merchandiser 10. Except as described below, the night cover 162 is the same as the night cover 62 described with regard to FIGS. 1-3, and common elements are given the same reference numerals. As shown, the night cover 162 has a lower portion 174 and an upper portion 178 that is defined by an open section 182. As illustrated, the open section 182 has a plurality of substantially uniform rectangular (e.g., square) openings 198 that permit passage of warm ambient air through the night cover 162.

Figure 5:
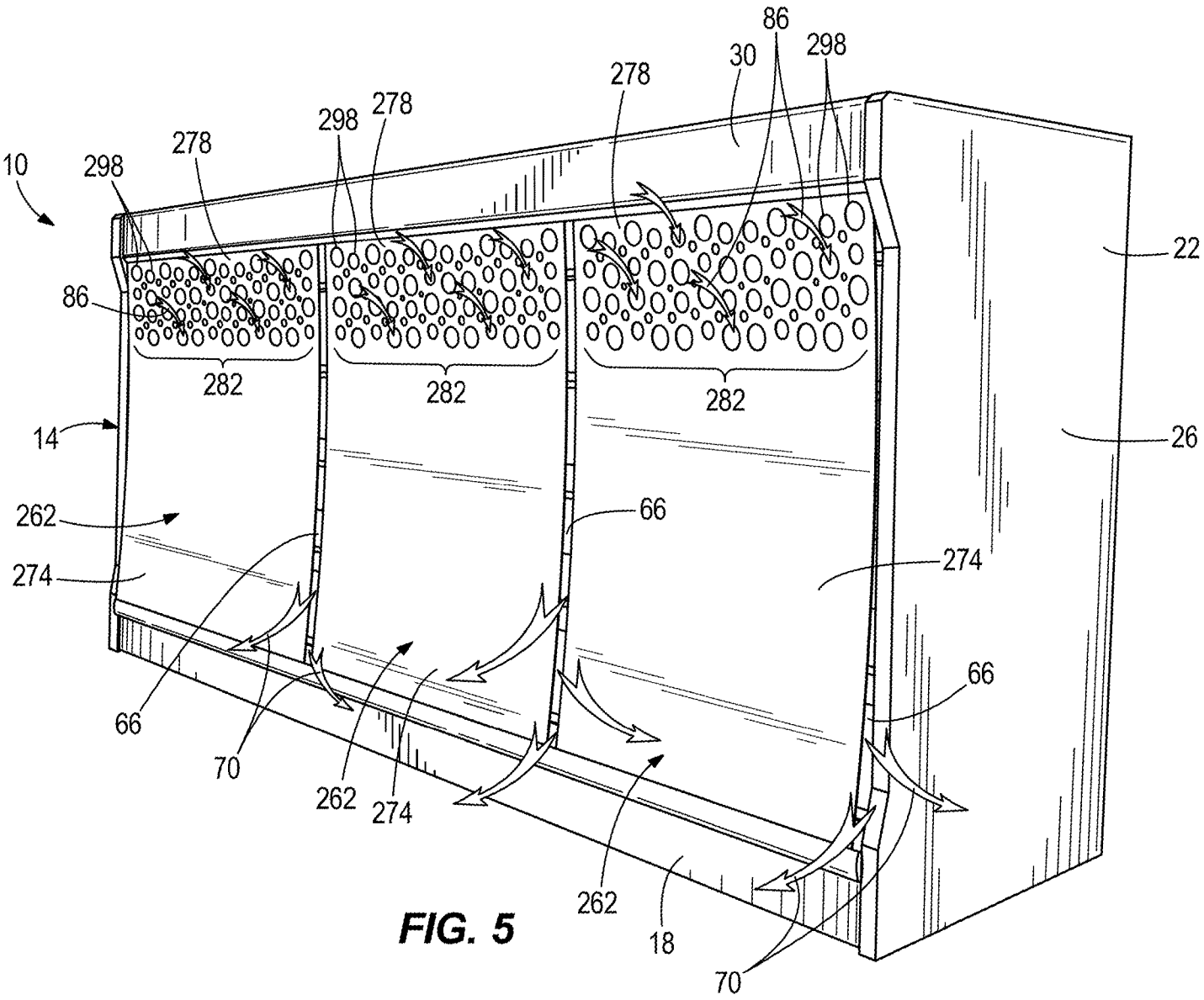
FIG. 5 is a perspective view of the merchandiser including night covers with open sections defined by different-sized openings.

FIG. 5 illustrates another exemplary night cover 262 that can be used with the merchandiser 10. Except as described below, the night cover 262 is the same as the night cover 62 described with regard to FIGS. 1-3, and common elements are given the same reference numerals. As shown, the night cover 262 has a lower portion 274 and an upper portion 278 that is defined by an open section 282. As illustrated, the open section 282 has a plurality of non-uniform circular openings 298 that permit passage of warm ambient air through the night cover 162.

Figure 6:
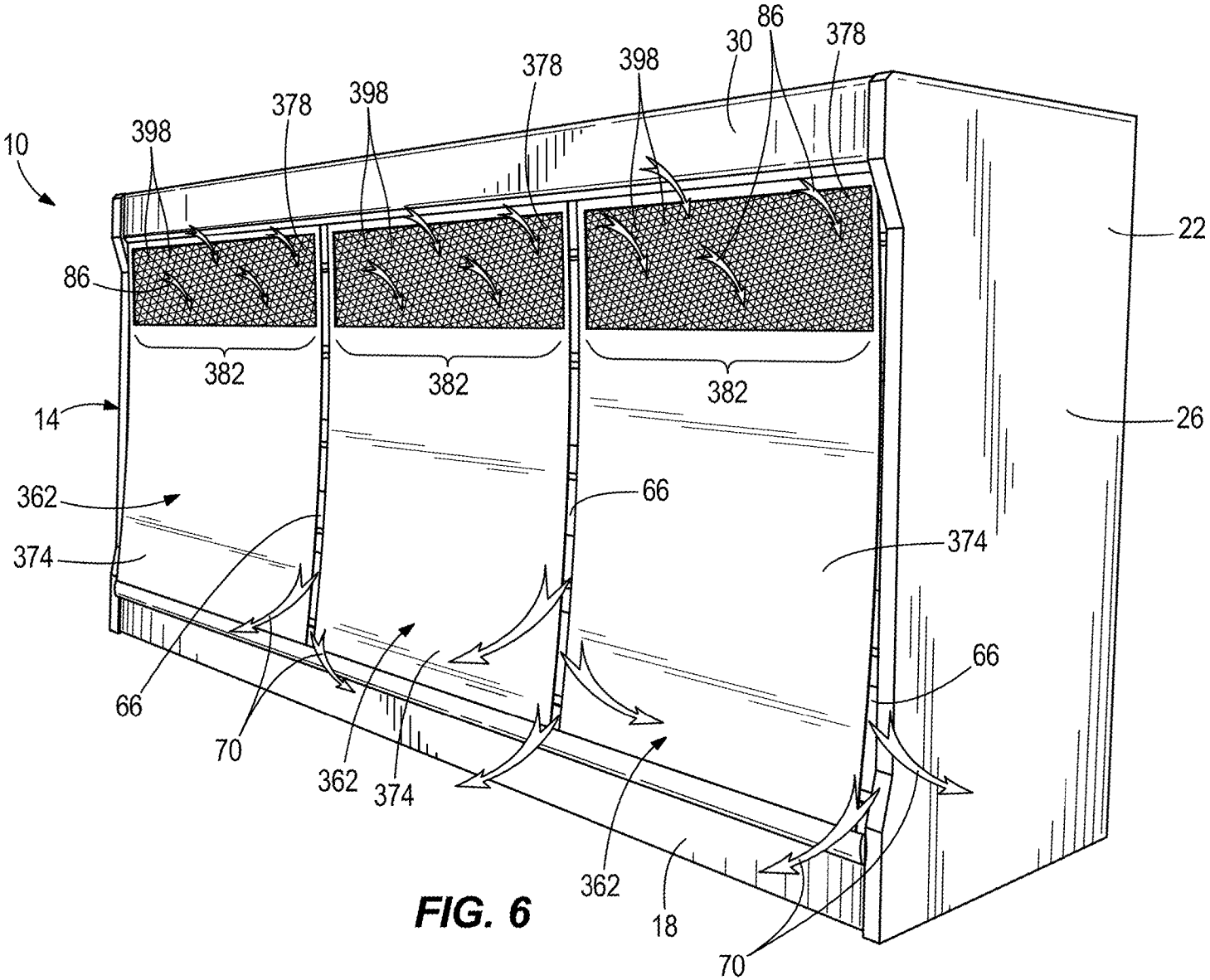
FIG. 6 is a perspective view of the merchandiser including night covers with open sections defined by mesh material.

FIG. 6 illustrates another exemplary night cover 362 that can be used with the merchandiser 10. Except as described below, the night cover 362 is the same as the night cover 62 described with regard to FIGS. 1-3, and common elements are given the same reference numerals. As shown, the night cover 362 has a lower portion 374 and an upper portion 378 that is defined by an open section 382. As illustrated, the lower portion 374 is formed of a first material (e.g., nylon) and the upper portion 378 is formed of the same or a different material. For example, the upper portion 378 can be formed of a mesh material that has a plurality of small openings 398 that define the open section 382.

Figure 7:
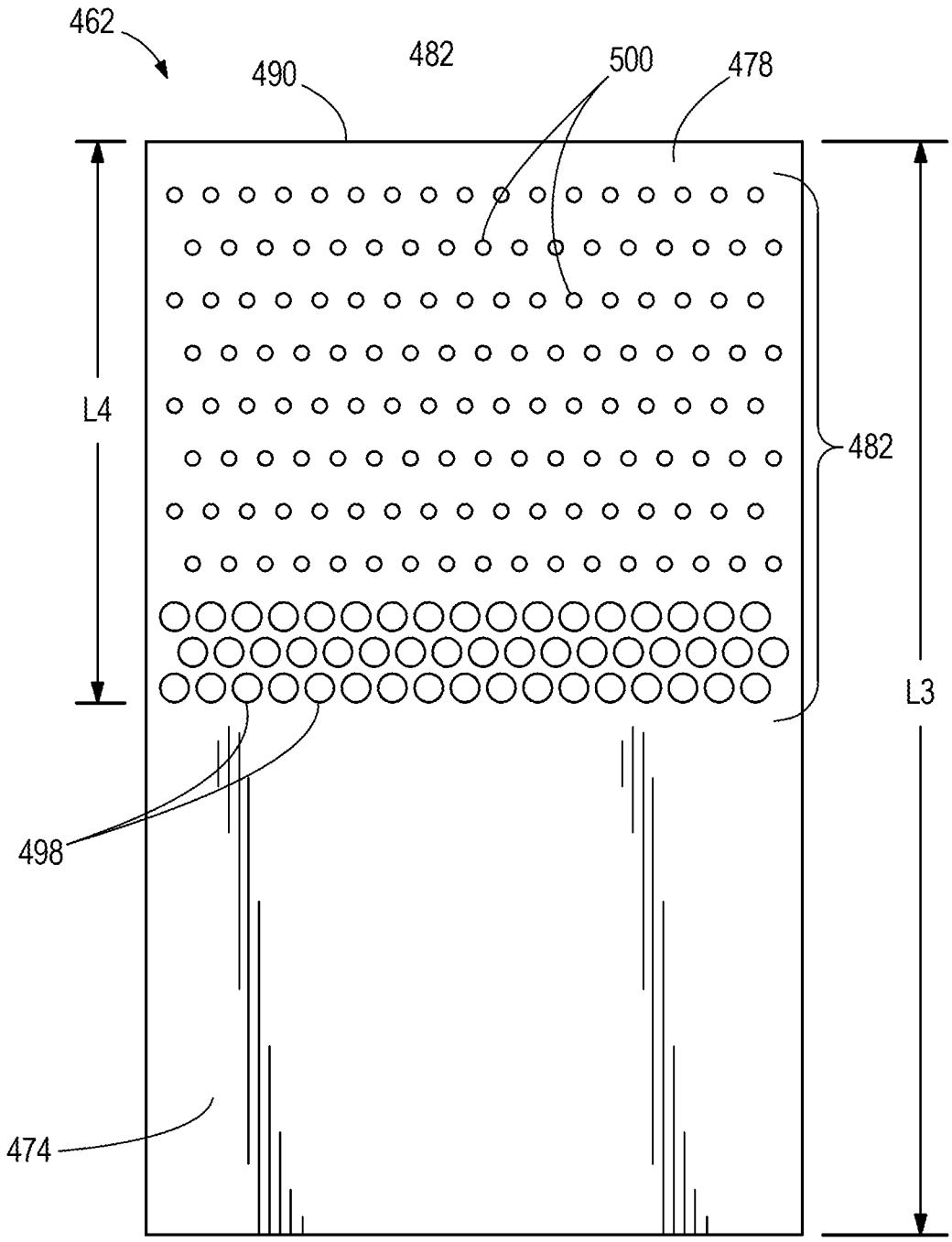
FIG. 7 is a front plan view of another exemplary night cover with an open section defined by two sets of different-sized openings.

FIG. 7 illustrates another exemplary night cover 462 that can be used with the merchandiser 10. Except as described below, the night cover 462 is the same as the night cover 62 described with regard to FIGS. 1-3, and common elements are given the same reference numerals. The night cover 462 includes a lower portion 474 and an upper portion 478 that is defined by an open section 482. The night cover 462, including the lower portion 474 and the upper portion 478 has an overall length L3 (e.g., 65-80 inches) and an upper edge 490 (at the top of the night cover 462 as viewed in FIG. 7 or when facing the night cover 462 from outside the merchandiser 10). The upper portion has a length L4 (e.g., between approximately 30 inches and 50 inches. As described in detail below, the exposed length L1 of the night cover 462 in the deployed position on the merchandiser 10 encompasses at least a portion of the overall length L3 and at least a portion of the length L4.

The illustrated open section 482 has a first plurality of openings 498 that are similar to the openings 98 described with regard to FIG. 1, although the openings 498 can be provided in other shapes sizes (e.g., the openings 198, 298, 398 described and illustrated with regard to FIGS. 4-6). Generally, the openings 498 are sized within a first size range (e.g., between approximately 1.5 inches and 2.5 inches in diameter or width) to permit flow of ambient air through the night cover 462.

With continued reference to FIG. 7, the open section 482 also has a second plurality of openings 500 disposed adjacent the upper edge 490 and perforating the night cover 462 in the area between the openings 498 and the upper edge 490. The openings 500 are generally smaller than the openings 498. More specifically, the openings 500 are sized within a second size range (e.g., between approximately 0.5 inches and 1.5 inches in diameter or width, 0.25 inches and 2.5 inches, etc.) to permit flow of ambient air through the night cover 462. The openings 500 can be shaped in many ways (e.g., polygonal, ovular, etc.). Also, although the openings 500 are generally smaller than the openings 498, the second size range can overlap the first size range.

When the night cover 462 is pulled down so that it extends across the access opening 42, the openings 498 are exposed before the openings 500 so that, for relatively short height access openings 42 (e.g., access openings 42 with a length that is shorter than the length L3), some or all of the larger openings 498 will be exposed while none or some of the openings 500 will be exposed. In other words, for short height access openings 42, the exposed height or length L1 of the night cover 462 is smaller than the length L3 such that some or all of the smaller openings 500 remain unexposed (e.g., rolled up in the night cover assembly). For larger access openings 42 (e.g., access openings 42 with a length that is approximately or the same as the length L3), a larger area of the night cover 462 is exposed. As such, the overall exposed height or length L1 of the night cover 462 approaches or equals the length L3, with a more significant portion (or all) of the openings 500 being exposed.

It has been found that the ratio of the size of the open section 82, 182, 282, 382, 482 relative to the access opening 42 does not increase at the same rate as the size of the access opening 42 increases. That is, for relatively large night covers, the size of the open section has a smaller exposed surface area relative to the overall surface area of the exposed portion of the night cover (i.e. the ratio of the surface area of the open section relative to the surface area of the exposed portion of the night cover is relatively small). For relatively small night covers, the size of the exposed open section has a larger surface area relative to the overall surface area of the night cover (i.e. the ratio of the surface area of the open section relative to the surface area of the exposed portion of the night cover is larger than the ratio for large night covers). As such, the amount of ambient airflow through the night cover does not increase at the same rate as the ratio at which the overall length of the night cover increases.

For example, when the access opening 42 increases from 55 inches to 72 inches (an increase in size of approximately 30%) the amount of ambient airflow passing through the night cover to make up spilled cold air increases by a percentage that is less than 30%. In this manner, the night cover 462 with relatively large openings 498 and relatively small openings 500 defined in the open section 482 can be universally utilized on merchandisers with small access openings 42 as well as on merchandisers with relatively large access openings 42 without any modification.

Generally, the ambient airflow through the night cover 62, 162, 262, 362, 462 has a substantially laminar airflow velocity profile so that the ambient air becomes entrained in and does not penetrate the air curtain 58. That is, the ambient airflow passing through the night cover 62, 162, 262, 362, 462 has a velocity that is less than a velocity of the air curtain 58. As such, the air curtain 58 acts as a barrier to the ambient air that makes up for the spilled cold air escaping the merchandiser 10. This barrier results in relatively cold product temperature(s) within the product display area 34 and increases the refrigerating efficiency of the merchandiser 10 by as much as, if not more than, 10%.

Various features and advantages of the invention are set forth in the following claims.

The invention claimed is:

1. A night cover for a refrigerated merchandiser and positionable to substantially enclose a product display area of the merchandiser, the night cover comprising:

a first portion; and a second portion disposed above the first portion and cooperating with the first portion to define a first surface area, the second portion defining a second surface area and including an open section having a plurality of openings defined by first openings and second openings, the open section configured to permit ambient airflow through the night cover, wherein each of the second openings is smaller than any of the first openings, wherein at least some of the first openings are horizontally spaced apart from each other across a width of the second portion, wherein at least some of the first openings are vertically spaced apart from each other, and wherein at least some of the second openings are disposed between an upper edge of the night cover and the first openings that are vertically spaced apart from each other.

2. The night cover of claim 1, wherein the first openings have a circular shape or a rectangular shape, and the second openings have a circular shape or a rectangular shape.

3. The night cover of claim 1, wherein the first and second openings are arranged in an array across the second portion.

4. The night cover of claim 1, wherein the first portion is formed from a first material and the second portion is formed from a second material that is different from the first material.

5. The night cover of claim 1, wherein a ratio of the first surface area to the second surface area is between approximately 9:1 and 14:1.

6. The night cover of claim 1, wherein the night cover is a pull-down night cover.

7. The night cover of claim 1, wherein the open section is disposed adjacent a top edge of the night cover.

8. The night cover of claim 1, wherein the first portion is releasably coupled to the second portion.

9. The night cover of claim 1, wherein all of the second openings are disposed between the upper edge of the night cover and the first openings that are vertically spaced apart from each other.

* * * * *